US005718335A

United States Patent [19]

Boudreaux

[11] Patent Number: 5,718,335

[45] Date of Patent: Feb. 17, 1998

[54] PACKAGING ASSEMBLY INCLUDING ACTUATOR ASSEMBLY FOR MANIPULATING AN ITEM WITHIN THE PACKAGE ASSEMBLY

[75] Inventor: Mark D. Boudreaux, Cincinnati, Ohio

[73] Assignee: Hasbro, Inc., Pawtucket, R.I.

[21] Appl. No.: 768,161

[22] Filed: Dec. 13, 1996

[51] Int. Cl.[6] ..... B65D 25/10; B65D 73/00

[52] U.S. Cl. ..... 206/461; 206/775; 206/493

[58] Field of Search ..... 206/461, 467, 206/469, 468, 470, 471, 775, 779, 781, 782, 493

[56] References Cited

U.S. PATENT DOCUMENTS

| | | | |
|---|---|---|---|
| 1,859,050 | 5/1932 | Poppe . | |
| 2,325,224 | 7/1943 | Bryant, Sr. . | |
| 4,261,461 | 4/1981 | Kizlauskas . | |
| 4,331,237 | 5/1982 | Edell . | |
| 4,811,844 | 3/1989 | Moulding, Jr. et al. . | |
| 4,848,577 | 7/1989 | Hoffman et al. | 206/467 |
| 5,129,516 | 7/1992 | Theros | 206/471 X |
| 5,188,222 | 2/1993 | Pierce . | |
| 5,289,916 | 3/1994 | Mickelberg . | |
| 5,289,917 | 3/1994 | Chabria . | |
| 5,358,113 | 10/1994 | Hellenbrand | 206/471 X |
| 5,411,138 | 5/1995 | Klawiter . | |
| 5,435,447 | 7/1995 | Weatherford et al. . | |

*Primary Examiner*—Jacob K. Ackun
*Attorney, Agent, or Firm*—Kurt R. Benson

[57] ABSTRACT

A packaging assembly for an item to be displayed, such as a toy action figure, enables a prospective purchaser to manipulate the item by means of an external actuator. More specifically, the packaging assembly includes a housing having a plurality of walls which cooperate to define an interior space, and an actuator assembly for actuating a movement of the item within the packaging assembly. The actuator assembly includes an actuator element which is releasably coupled to the item wherein movement of the actuator element causes a corresponding movement of the item to be displayed. A portion of the actuator element is accessible through an opening in one of the walls for movement of the actuator element. In a preferred embodiment, the housing includes a rear wall and a transparent blister which is mounted to the rear wall. The blister and rear wall cooperate to form an interior space in which the item is received. The preferred packaging assembly further includes a display base received within the packaging assembly. The display base includes a body portion and a rotatable platform mounted on the body portion. The item is releasably mounted to the movable platform, and the platform is rotatable through 360° of rotation by means of a thumb wheel so that the item can rotated through 360° of rotation within the interior space and can therefore be viewed at any angle.

16 Claims, 4 Drawing Sheets

PACKAGING ASSEMBLY INCLUDING ACTUATOR ASSEMBLY FOR MANIPULATING AN ITEM WITHIN THE PACKAGE ASSEMBLY

BACKGROUND AND SUMMARY OF THE INVENTION

The instant invention relates to packaging for products to be displayed and sold at retail stores, and in particular to a packaging assembly for an item, such as a toy action figure, including an actuator assembly which enables the prospective purchaser to manipulate the item within the package.

Packaging which enables a prospective purchaser to manipulate an item within the package have heretofore been known in the art. In this regard, the U.S. patents to Weatherford et al U.S. Pat. No. 5,435,447; Klawiter U.S. Pat. No. 5,422,138; Mickelberg U.S. Pat. No. 5,289,916; and Pierce U.S. Pat. No. 5,188,222 represent the closest prior art to the subject matter of the instant invention of which the applicant is aware. The U.S. patent to Weatherford discloses a transparent blister package for a pair of shears wherein one handle of the shears extends outwardly of the package through a slot in the side so that a prospective purchaser may manipulate the handles. The package further includes an enlarged interior cavity which permits movement of the blades within the package when the handles are manipulated. The Patent to Klawiter discloses a packaging assembly for a toy vehicle including slots and opening which permit the prospective purchaser to manipulate the wheels of the toy vehicle prior to purchase. The Patent to Mickelberg discloses another packaging assembly which includes openings in the package walls to permit limited handling and manipulation of the toy prior to purchase. The Patent to Pierce discloses a blister package for a watch including two recesses positioned adjacent to the actuator buttons of the watch. A person may place his/her fingers within the recesses to actuate the buttons of the watch without actually opening the package.

While each of the above-noted packages is effective for its intended purpose, there are drawbacks associated with each of the packages. With regard to Weatherford, Klawiter and Mickelberg, each of these packages enables the prospective purchaser to actually touch to product. While this is an advantage in the sale of some products, it could be a disadvantage in the sale of other products. For example, in the sale of potential collectors items such as dolls, and action figures, the ability to manipulate the item without actually touching the item could be a very attractive selling feature to a prospective purchaser. With regard to Pierce, although the recesses enable the watch to be tested without opening the package, the plastic blister packages are usually stiff and relatively inflexible and could be difficult for children and/or the elderly, to manipulate.

Accordingly, to overcome the disadvantages of the prior art, the instant invention provides a packaging assembly which enables a purchaser to manipulate the enclosed item by means of an external actuator element. In general, the packaging assembly comprises a housing having a plurality of walls which cooperate to define an interior space, and an actuator assembly for actuating a movement of the item within the packaging assembly. The actuator assembly includes an actuator element which is releasably coupled to the item wherein movement of the actuator element causes a corresponding movement of the item to be displayed. A portion of the actuator element is accessible through an opening in one of the walls for movement of the actuator element. More specifically, in a preferred embodiment of the invention which is intended to house a toy action figure, the housing includes a display card that forms a rear wall of the housing, and a transparent blister which is mounted to the rear wall. The blister and display card cooperate to form an interior space in which the action figure is received. The preferred packaging assembly further includes a display base which is received within the interior space. The display base includes a body portion which is mounted to the display card, and a rotatable platform mounted on the body portion. The item is releasably mounted to the movable platform, and the platform is rotatable through 360° of rotation by means of a thumb wheel accessible through the rear wall so that the item can rotated through 360° of rotation within the interior space. Other intended embodiments include actuator assemblies which are releasably coupled to movable parts of the enclosed item whereby manipulation of the actuator element would cause a corresponding movement of a movable part of the item. For example, in connection with an action figure having a movable arm, the actuator element could be coupled by a suitable linkage to the movable arm whereby movement of the actuator element would cause a corresponding movement of the movable arm. Still further it is intended that multiple actuators may be utilized to manipulate different movable parts of the item, or alternatively one actuator could move entire item while another actuator could move a movable part thereof.

Accordingly, among the objects of the instant invention are: the provision of a packaging assembly which enables a prospective purchaser to manipulate an item within the package by means of an external actuator element; the provision of a packaging assembly which enables a prospective purchaser to rotate, or manipulate, an item within the package so that it can be viewed from different angles; the provision of a packaging assembly which enables a prospective purchaser to manipulate a movable part of the item being displayed; the provision of a packaging assembly which enables a prospective purchaser to rotate an item 360° within the package; and the provision of such a packaging assembly including a display base with a rotatable platform and a manually actuated thumb wheel for rotating the rotatable platform.

Other objects, features and advantages of the invention shall become apparent as the description thereof proceeds when considered in connection with the accompanying illustrative drawings.

DESCRIPTION OF THE DRAWINGS

In the drawings which illustrate the best mode presently contemplated for carrying out the present invention.

DESCRIPTION OF THE PREFERRED EMBODIMENT

Figure 1:
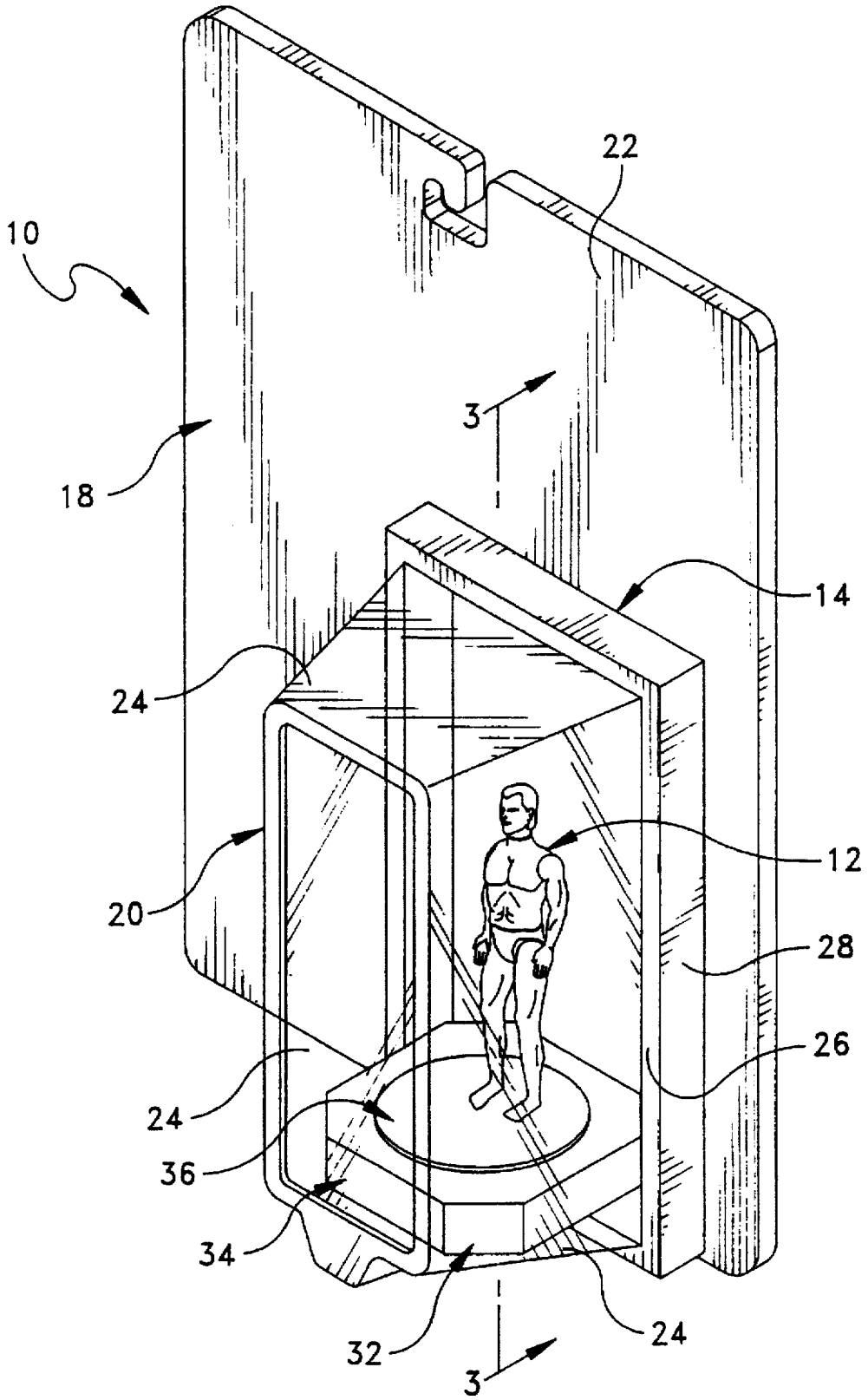
FIG. 1 is a perspective view of the packaging assembly of the instant invention.
Figure 2:
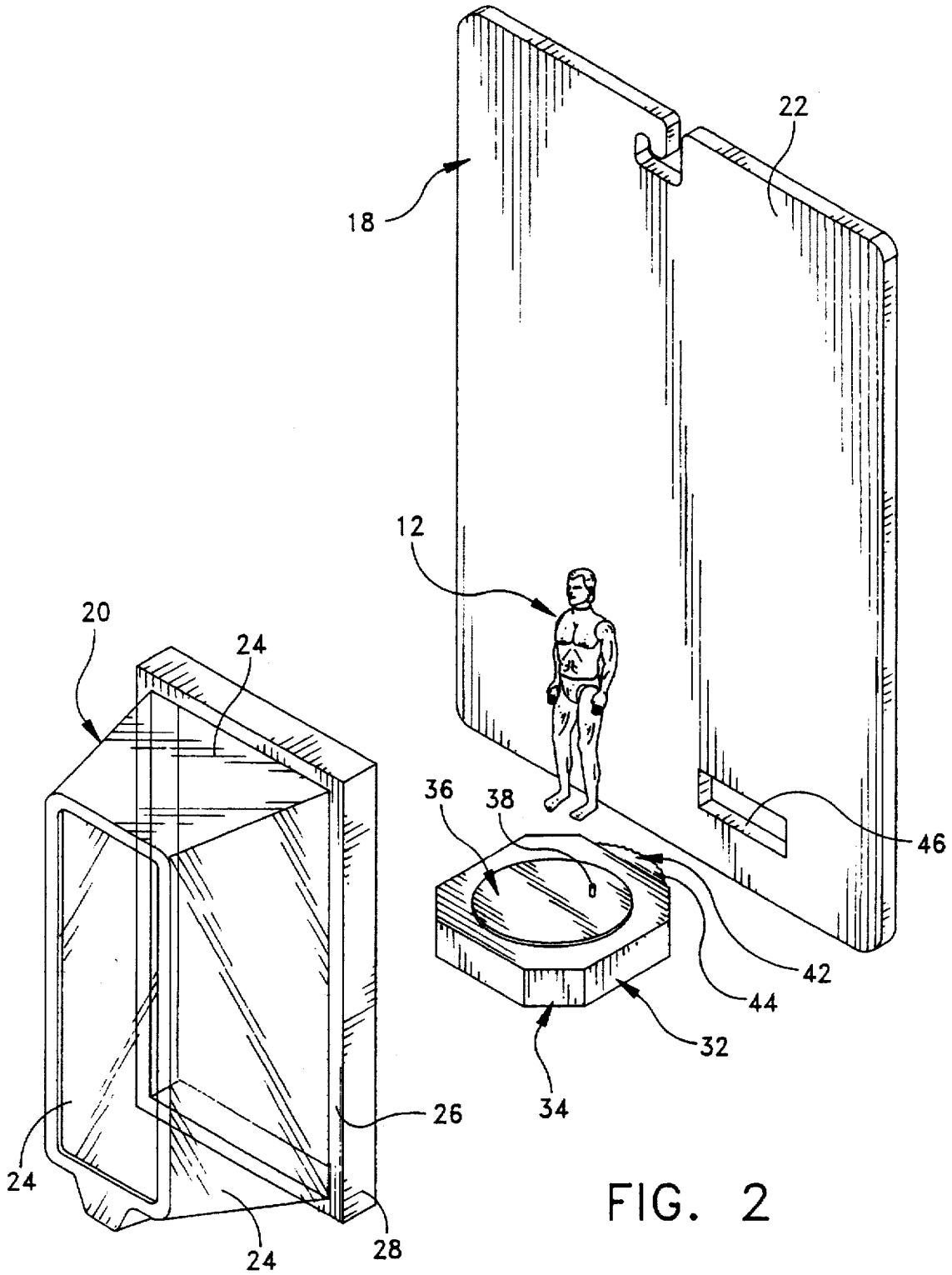
FIG. 2 is an exploded perspective view thereof.
Figure 3:
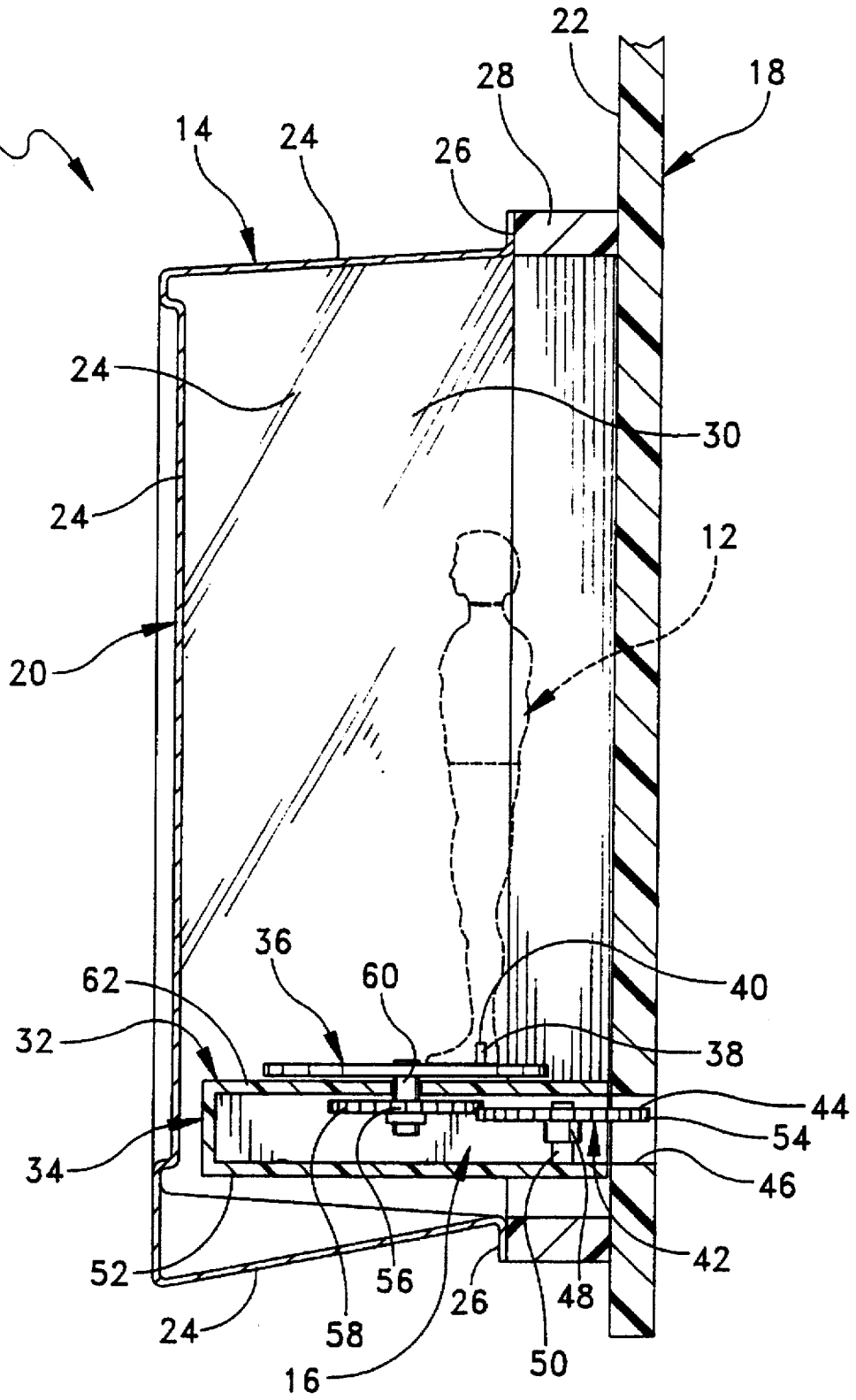
FIG. 3 is a cross-sectional view thereof taken along line 3—3 of FIG. 1.
Figure 4:
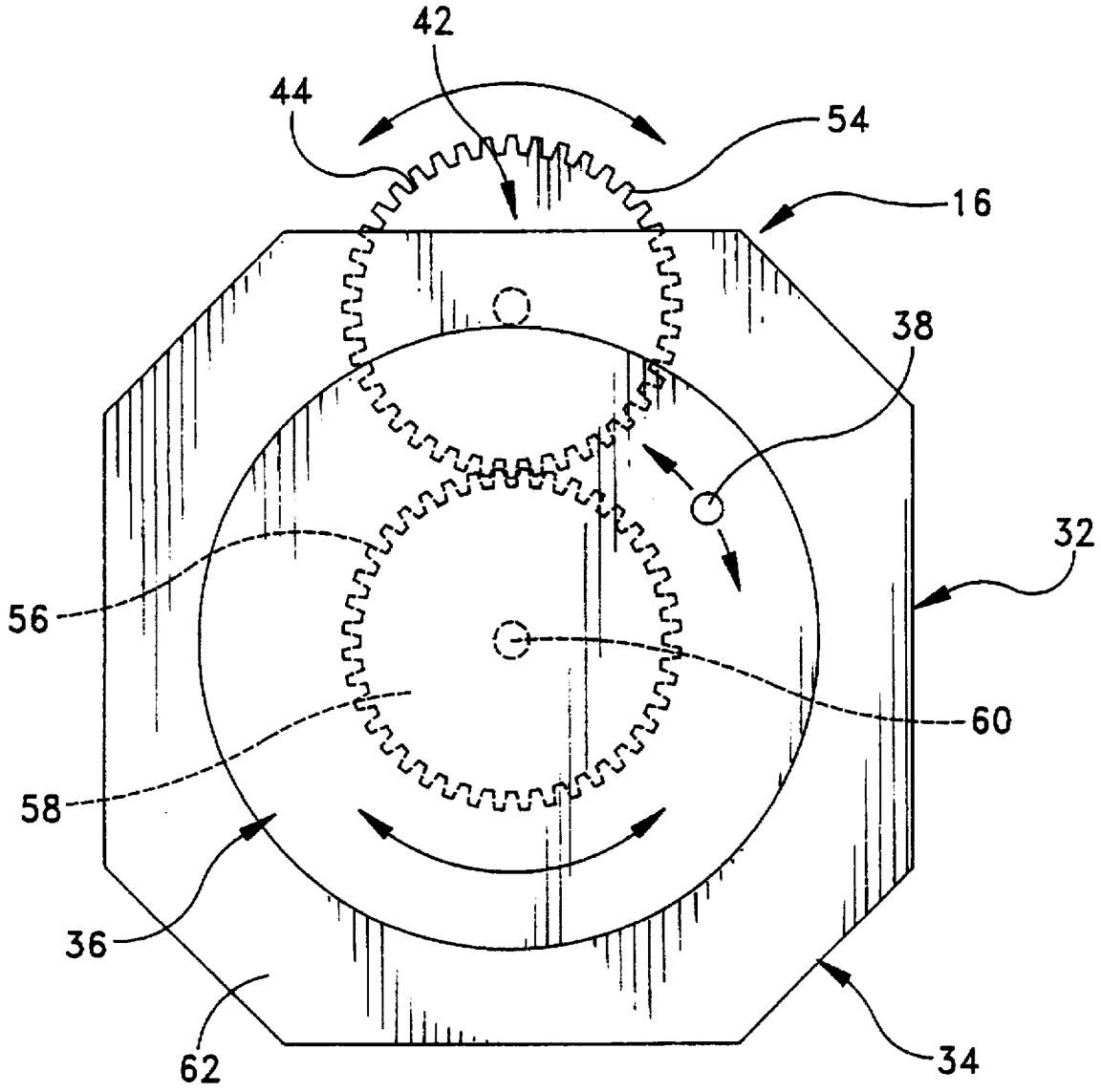
FIG. 4 is a top view of the display base assembly.

Referring now to the drawings, the packaging assembly of the instant invention is illustrated and generally indicated at 10 in FIGS. 1–4. As will hereinafter be more fully described, the instant packaging assembly 10 is configured to enable a prospective purchaser to manipulate an enclosed item generally indicated at 12, by means of an external actuator.

The item 12 to be displayed can be any item which is normally packaged and displayed for retail sale. In connection with the present embodiment, the item 12 comprises a toy action figure, which may or may not have movable parts, i.e. arms, legs, head, etc.

In general, the packaging assembly 10 comprises a housing generally indicated at 14 for enclosing the item 12, and an actuator assembly generally indicated at 16 for manipulating the item 12 within the housing. The housing 14 generally includes a plurality of walls that cooperate to define a suitable interior space in which the item 12 is received for display. The housing 14 can be of any geometric configuration and have any number of walls, so long as the housing generally defines an interior space in which the item to be displayed can be received. One or more of the walls of housing 14 should be transparent so that the item 12 can be viewed within the housing 14. The actuator assembly 16 generally includes an actuator element to be described hereinafter which is accessible through an opening in one of the walls and which is releasably coupled to the item 12 such that movement of the actuator element causes a corresponding movement of the item 12.

The housing 14 more specifically includes a display card generally indicated at 18 that forms a rear wall of the housing 14, and a transparent blister generally indicated at 20 which is mounted to the front surface 22 of the display card 18. The blister 20 includes a plurality of transparent walls 24 which terminate in peripheral edges 26. The peripheral edges 26 are secured to an edge frame 28 which is in turn secured to the front surface 22 of the display card 18 by means of a suitable adhesive. The blister 20 and display card 18 cooperate to form a closed interior space 30 in which the action FIG. 12 is received. The front surface 22 of the card 18 may include fanciful illustrations and descriptive material (not shown) germane to the item 12.

The packaging assembly further includes a display base generally indicated at 32 which is received within the interior space 30. The display base 32 includes a body portion generally indicated at 34 which is mounted to the front surface 22 of the display card 18, and a platform, or mounting element generally indicated at 36, rotatably mounted on the body portion 34 on which the item 12 is releasably mounted. The body portion 34 is generally square in configuration and has a hollow interior which houses the actuator assembly 16. The body portion 34 may be secured to the display card 18 by an adhesive, or alternatively may be releasably secured by mounting elements (not shown) which interlock with the display card 18. In order to releasably mount the action FIG. 12 to the platform 36, the platform 36 is provided with a mounting post 38 which is received into a bore 40 (FIG. 3) in one of the feet of the action FIG. 12. Although the mounting post 38 is shown as the preferred means of mounting the action FIG. 12, any means of releasably holding the item 12 to the platform 36 would be suitable within the scope of the invention.

In operation, the platform 36 is rotatable through 360° of rotation so that the item 12 can rotated through 360° of rotation within the interior space 30. Rotation of the platform 36 is accomplished by manipulation of the actuator assembly 16. The actuator assembly 16 includes an actuator element generally indicated at 42, which in the present embodiment comprises a thumb wheel mounted within the body portion 34 of the display base 32. The peripheral edge 44 of the thumb wheel 42 is accessible to the purchaser through a slot 46 formed in the display card 18. The thumb wheel 42 includes a central hub 48 which is rotatably received on a post 50 fixed to the bottom wall 52 of the body portion 34 of the display base 32. Gear teeth 54 on the peripheral edge 44 of the thumb wheel 42 intermesh with gear teeth 56 on a drive wheel 58 which is also mounted within the body portion 34 of the display base 32 and coupled to the platform 36 by a drive shaft 60 which extends through the top wall 62 of the body portion 34. Accordingly, it can be seen that rotation of the actuator element (thumb wheel) 42 through the opening 46 in the rear wall 18 of the housing 14 causes a corresponding rotation of the drive wheel 58 and the platform 36.

Although one specific platform 36 and actuator assembly 16 is illustrated and described herein for rotation of the item 12, it is to be understood that other types of mounting elements, actuator elements, and actuator assemblies, including levers, push buttons, etc., could be substituted for the present embodiment to accomplish either rotation of the item, or other desired movements of the item within the interior space. For example, the platform 36 and actuator assembly 16 may be configured to provide an arcuate or side-to-side movement of the item 12 over the surface of the display base 32. As another example, a platform and actuator assembly could be configured to provide upward and downward movement of the item 12 within the interior space 30.

Furthermore, other intended embodiments of the present invention might include actuator linkages which are releasably coupled to movable parts of the enclosed item whereby manipulation of the actuator element would cause a corresponding movement of a movable part of the item. For example, in connection with an action figure having a movable arm, the actuator element, which might comprise a lever, would be coupled by a suitable linkage to the movable arm of the item whereby movement of the actuator element would cause a corresponding movement of the movable arm. Still further it is intended that multiple actuators may be utilized to manipulate different movable parts of the item, or alternatively one actuator could move entire item while another actuator could move a movable part thereof.

It can therefore be seen that the instant invention provides a novel and unique packaging assembly which is particularly useful and effective in displaying items for retail sale. Unlike the prior art, the present packaging assembly enables a prospective purchaser to manipulate an item within the package by means of an external actuator element. While providing additional functionality and novelty to the packaging, this unique configuration also provides a substantial selling feature to collectors of action figures and dolls, as well as to the general public, because the items are not directly handled by prospective purchasers and hence the original condition of the item is preserved prior to the actual sale thereof. For these reasons, the instant invention is believed to represent a significant advancement in the packaging art which has substantial commercial merit.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A packaging assembly for an item to be displayed comprising:

a housing including a plurality of walls which cooperate to define an interior space, at least one of said walls comprising a transparent wall, said item to be displayed being received within said interior space;

an actuator assembly for actuating movement of said item to be displayed, said actuator assembly including an actuator element having a portion thereof which is accessible through an opening in one of said plurality of walls; and a display base including a body portion and a movable platform mounted on said body portion, said item to be displayed being releasably mounted on said platform, said actuator element communicating with said platform so that movement of said actuator element causes corresponding movement of said platform and said item mounted thereon.

2. The packaging assembly of claim 1 wherein said actuator assembly is disposed within said body portion of said display base.

3. The packaging assembly of claim 1 wherein said movable platform is rotatably mounted on said body portion, said actuator element being coupled to said rotatable platform so that movement of said actuator element causes rotation of said platform.

4. The packaging assembly of claim 3 wherein said actuator element comprises a thumb wheel rotatably mounted within said body portion of said display base.

5. The packaging assembly of claim 3 wherein said actuator assembly includes a drive wheel mounted within said body portion, said drive wheel being coupled to said platform by a drive shaft which extends upwardly through an opening in a top wall of said body portion, said actuator element being coupled to said drive wheel so that actuation of said actuator element causes rotation of said drive wheel.

6. The packaging assembly of claim 5 wherein drive said wheel includes gear teeth along a peripheral edge thereof, said actuator element comprising a thumb wheel rotatably mounted within said body portion of said display base, said thumb wheel having gear teeth which intermesh with said teeth of said drive wheel wherein rotation of said thumb wheel causes corresponding rotation of said drive wheel.

7. A packaging assembly for an item to be displayed comprising:

a housing including a rear wail, and a transparent blister having a peripheral edge which is attached to said rear wall whereby said blister and said rear wail cooperate to define an interior space in which an item to be displayed is received;

an actuator assembly for actuating movement of said item to be displayed, said actuator assembly including an actuator element having a portion thereof which is accessible through an opening in said rear wall; and a display base including a body portion and a movable platform mounted on said body portion, said item to be displayed being releasably mounted on said platform, said actuator element being coupled to said platform so that movement of said actuator element causes corresponding movement of said platform and said item mounted thereon.

8. The packaging assembly of claim 7 wherein said actuator assembly is disposed within said body portion of said display base.

9. The packaging assembly of claim 7 wherein said movable platform is rotatably mounted on said body portion, said actuator element being coupled to said rotatable platform so that movement of said actuator element causes rotation of said platform.

10. The packaging assembly of claim 9 wherein said actuator element comprises a thumb wheel rotatably mounted within said body portion of said display base.

11. The packaging assembly of claim 9 wherein said actuator assembly includes a drive wheel mounted within said body portion, said drive wheel being coupled to said platform by a drive shaft which extends upwardly through an opening in a top wall of said body portion, said actuator element being coupled to said drive wheel so that actuation of said actuator element causes rotation of said drive wheel.

12. The packaging assembly of claim 11 wherein drive said wheel includes gear teeth along a peripheral edge thereof, said actuator element comprising a thumb wheel rotatably mounted within said body portion of said display base, said thumb wheel having gear teeth which intermesh with said teeth of said drive wheel so that rotation of said thumb wheel causes corresponding rotation of said drive wheel.

13. A packaging assembly for an item to be displayed comprising:

a housing including a plurality of walls which cooperate to define an enclosed interior space, one of said walls comprising a mounting wall, at least one other of said walls being transparent, said item being received in said interior space, a mounting platform in said interior space attached to said mounting wall, said item being mounted on said mounting platform so that said item is spaced from at least each of said walls other than said mounting wall, an actuator assembly for actuating movement of said item from the exterior of said packaging assembly, said actuator assembly communicating with said item through said mounting wall and said mounting platform for moving said item in response to manipulation of said actuator assembly from the exterior of said packaging assembly.

14. In the packaging assembly of claim 13, said actuator assembly being concealed in the interior of said housing by said mounting platform.

15. In the packaging assembly of claim 13, said item being unconnected to any of said walls other than through said mounting platform.

16. In the packaging assembly of claim 13, said actuator assembly being operative for moving said mounting platform for moving said item.

* * * * *